US006505026B2

(12) United States Patent
Hayakawa et al.

(10) Patent No.: US 6,505,026 B2
(45) Date of Patent: Jan. 7, 2003

(54) BELT DRIVING DEVICE AND IMAGE FORMING APPARATUS USING THE SAME

(75) Inventors: Tadashi Hayakawa, Kanagawa (JP); Eisuke Hori, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/925,489

(22) Filed: Aug. 10, 2001

(65) Prior Publication Data

US 2002/0021920 A1 Feb. 21, 2002

(30) Foreign Application Priority Data

Aug. 11, 2000 (JP) ..... 2000-245420

(51) Int. Cl.[7] ..... G03G 15/00
(52) U.S. Cl. ..... 399/303; 198/840; 399/165
(58) Field of Search ..... 399/297, 299, 399/302, 303, 165; 198/814, 816, 840, 842

(56) References Cited

U.S. PATENT DOCUMENTS

| | | | |
|---|---|---|---|
| 5,017,969 A | 5/1991 | Mitomi et al. | |
| 5,717,981 A | 2/1998 | Yamanaka | |
| 5,768,665 A | 6/1998 | Yamanaka et al. | |
| 6,208,826 B1 | 3/2001 | Yoshinaga et al. | |
| 2002/0046932 A1 * | 4/2002 | Wakana | 198/840 |

FOREIGN PATENT DOCUMENTS

| | | |
|---|---|---|
| JP | 5-18450 | 1/1993 |
| JP | 5-232753 | 9/1993 |
| JP | 11-2974 * | 1/1999 |

OTHER PUBLICATIONS

Patent Abstract of Japan, JP 4–055883, Feb. 24, 1992.
Patent Abstract of Japan, JP 10–047446, Feb. 20, 1998.
Patent Abstract of Japan, JP 4–098284, Mar. 30, 1992.

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus of the present invention includes an endless belt for conveying a recording medium. The belt is passed over four support rollers each being formed with an annular guide groove that receives a guide formed on the belt. Assume that a biasing force $F_2$ acts on one end of at least one support roller remote from the guide of the belt, and a biasing force $F_1$ acts on the other side close to the guide member. Then, a relation of $F_1<F_2<1.5\times F_1$ holds. This frees the image transfer surface of the belt from slackening and creasing.

17 Claims, 4 Drawing Sheets

BELT DRIVING DEVICE AND IMAGE FORMING APPARATUS USING THE SAME

BACKGROUND OF THE INVENTION

The present invention relates to a belt driving device for a copier, printer, facsimile apparatus or similar image forming apparatus and an image forming apparatus using the same.

One of conventional image forming apparatuses of the type using a belt driving device includes an endless belt facing image carriers. The belt conveys a paper sheet or similar recording medium, so that toner images are transferred from the image carriers to the paper sheet one above the other. The image carriers are often implemented as photoconductive belts or intermediate image transfer belts. While such belts each are passed over a plurality of rollers, it is apt to deviate in the direction perpendicular to the direction of movement (axial direction of the rollers). In the worst case, the belt slips out of the rollers. The deviation of the belt does not occur if the belt moves in an ideal condition in which the parallelism of the rollers and the thickness, circumferential length and tension of the belt are free from errors and irregularity. In practice, however, the errors and irregularity are not avoidable unless the accuracy of the individual part and accurate assembly are enhanced, resulting in an increase in cost. It is therefore necessary to use a mechanism for preventing the belt from deviating.

In light of the above, it has been proposed to position a guide member for limiting the deviation on the inner surface of the belt at one of opposite edges in the direction of width, and form an annular groove in each roller for receiving the guide member. This configuration obviates the deviation of the belt at lower cost than a configuration in which guide members are provided on both edges of the inner surface of the belt.

However, the above prior art scheme using a single guide member has the following problems left unsolved. When the belt in movement deviates to the side where the guide member is positioned, the image transfer surface of the belt slackens or creases and brings about defective image transfer. If the belt with the slackened or creased image transfer surface further moves, then the guide member is apt to slip out of the grooves of the rollers and get on the rollers.

Technologies relating to the present invention are disclosed in, e.g., Japanese Patent Laid-Open Publication

SUMMARY OF THE INVENTION

It is an object of the present invention to provide a low cost, belt driving device capable of causing a belt to stably move without slackening or creasing and without a guide member getting over the guide portions of rollers, and an image forming apparatus using the same.

In accordance with the present invention, a belt driving device includes an endless belt member passed over a plurality of roller members. A driving device causes at least one of the roller members to rotate. A biasing device presses opposite ends of at least one of the roller members to thereby apply tension to the belt member. A guide member is formed on the inner surface of the belt member at one of opposite sides in the direction of width of the belt member for guiding the belt member. A guide portion is formed in each roller member and engaged with the guide member. The biasing device is configured such that a biasing force $F_2$ acting on one end of the roller member remote from the guide member of the belt member is greater than a biasing force $F_1$ acting on the other side close to the guide member.

Also, in accordance with the present invention, an image forming apparatus includes a plurality of image stations each including a respective image carrier on which a toner image is formed. A belt driving device drives an image transfer belt that conveys a recording medium to which the toner image is transferred. The image transfer belt conveys the recording medium via image transfer positions, each of which is assigned to a particular image carrier included in each image station, so that toner images are sequentially transferred from the image carriers to the recording medium one above the other. The belt driving device includes an endless belt member passed over a plurality of roller members. A driving device causes at least one of the roller members to rotate. A biasing device presses opposite ends of at least one of the roller members to thereby apply tension to the belt member. A guide member is formed on the inner surface of the belt member at one of opposite sides in the direction of width of the belt member for guiding the belt member. A guide portion is formed in each roller member and engaged with the guide member. The biasing device is configured such that a biasing force $F_2$ acting on one end of the roller member remote from the guide member of the belt member is greater than a biasing force $F_1$ acting on the other side close to the guide member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
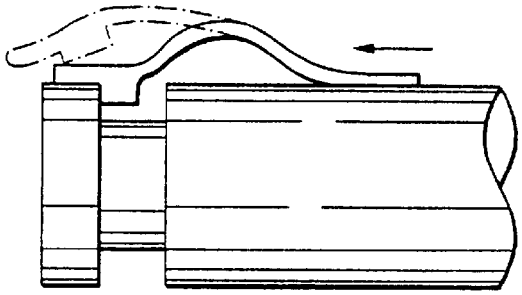
Fig. 1 PRIOR ART
FIG. 1 is a fragmentary view for describing the problems of a conventional belt driving device.

Assume the prior art scheme stated earlier in which a guide member for limiting the deviation is formed on the inner surface of the belt at one edge in the direction of width, while an annular groove is formed in each roller for receiving the guide member. In this configuration, as shown in FIG. 1, when the belt in movement deviates to the side where the guide member is positioned, the image transfer surface of the belt slackens or creases and brings about defective image transfer, as discussed earlier. If the belt with the slackened or creased image transfer surface further moves, then the guide member is apt to slip out of the grooves of the rollers and get on the rollers.

Figure 2:
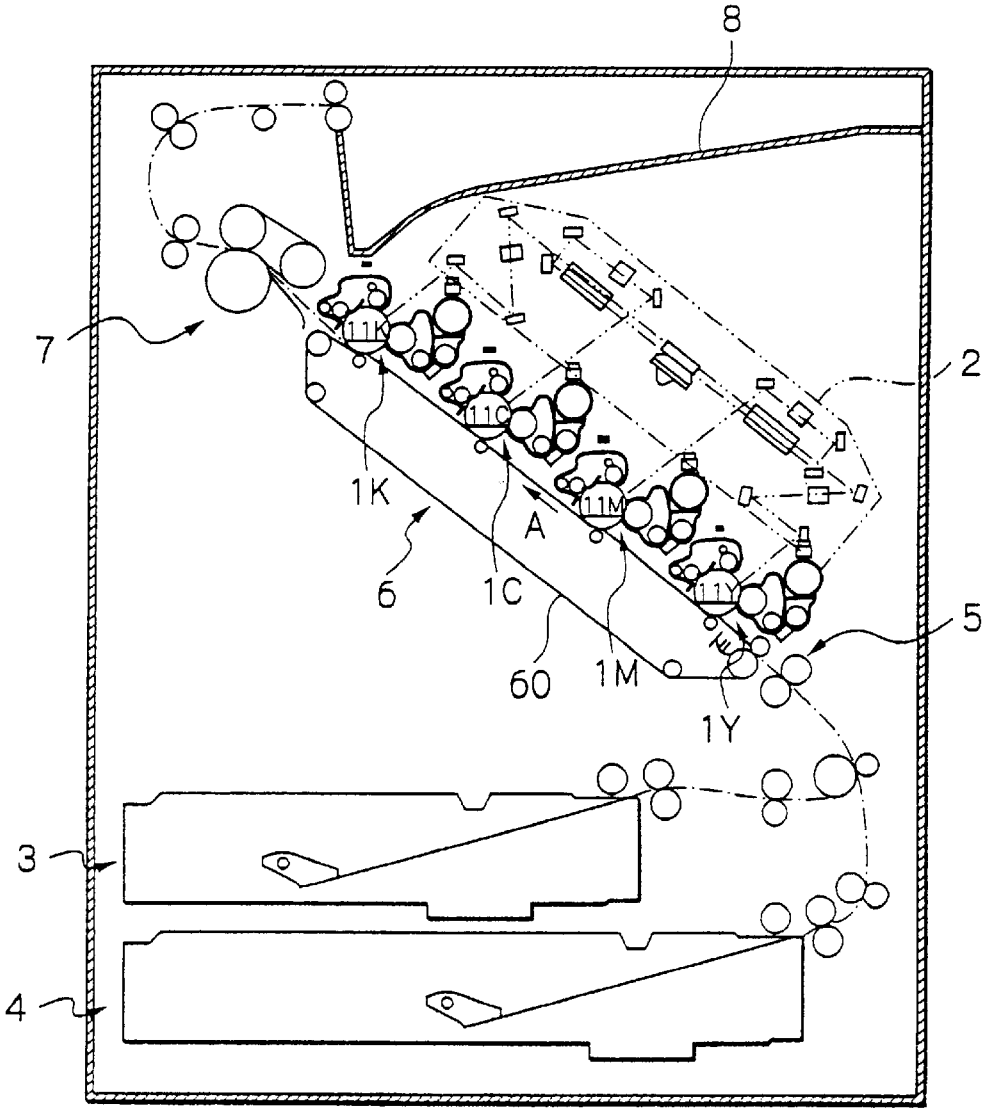
FIG. 2 is a view showing the general construction of a color laser printer embodying the present invention.

Referring to FIG. 2, an image forming apparatus embodying the present invention is shown and implemented as an electrophotographic color laser printer by way of example. As shown, the laser printer includes four image stations 1Y (yellow), 1M (magenta), 1C (cyan) and 1K (black) storing Y toner, M toner, C toner and K toner, respectively. Suffixes Y, M, C and K will be attached to the various constituents of the image stations as well. The image stations 1Y through 1K are sequentially arranged in this order in a direction A in which a paper sheet or similar recording medium is conveyed. The image station 1Y includes a drum unit including a photoconductive drum 11Y, and a developing unit. Likewise, the image stations 1M, 1C and 1K respectively include drum units including photoconductive drums 11M, 11C and 11K, and developing units. The image stations 1Y through 1K are arranged at preselected intervals in the direction A such that the axes of the drums 11Y through 11K are parallel to each other.

The laser printer further includes an optical writing unit 2, two sheet cassettes 3 and 4, a registration roller pair 5, an image transfer unit 6, a belt type fixing unit 7, and a print tray 8. The image transfer unit includes an endless belt or conveying member 60 for conveying a paper sheet via image transfer positions assigned to the image stations 1Y through 1K. The laser printer additionally includes a manual feed tray, toner containers each storing fresh toner of particular color, a waste toner bottle, a duplex print unit, and a power source unit although not shown specifically.

The optical writing unit 2 includes a light source, a polygonal mirror, an f-θ lens and mirrors. The writing unit 2 scans each of the drums 11Y through 11K with a laser beam in accordance with particular image data.

A paper sheet paid out from either one of the sheet cassettes 3 and 4 is conveyed to the registration roller pair 5 by rollers while being guided by guides not shown. The registration roller pair 5 once stops the paper sheet and then drives it at preselected timing. The belt 60 conveys the paper sheet handed over from the registration roller pair 5 via the image transfer positions of the image stations 1Y through 1K. Toner images of different colors are sequentially transferred to the paper sheet one above the other at the image stations 1M through 1K, completing a color image. The paper sheet with the color image has the color image fixed by the fixing unit 7 and is then driven out to the print tray 8. The route along which the paper sheet is so conveyed is indicated by a dash-and-dot line in FIG. 2.

Figure 3:
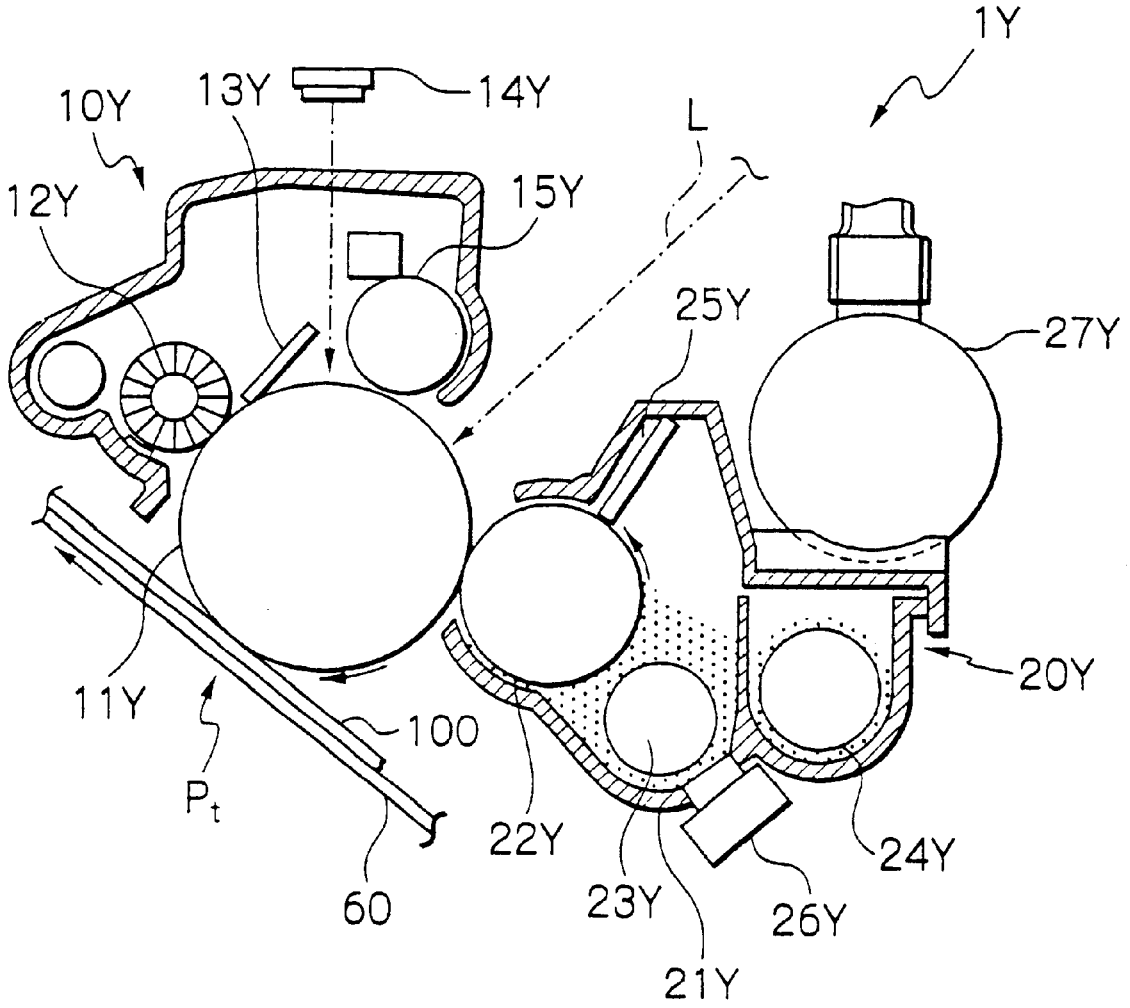
FIG. 3 is a view showing one of image stations included in the illustrative embodiment specifically.

FIG. 3 shows the Y image station 1Y in detail. The other image stations 1M, 1C and 1K are identical in configuration with the Y image station 1Y and will not be described specifically in order to avoid redundancy. As shown, the Y image station 1Y includes the previously mentioned drum unit and developing unit labeled 10Y and 20Y, respectively. The drum unit 10Y includes a brush roller 12Y, a counter blade 13Y, a discharge lamp 14Y, and a non-contact type charge roller 15Y. The brush roller 12Y applies a lubricant to the surface of the drum 11Y. The counter blade 13Y is angularly movable for cleaning the surface of the drum 11Y. The discharge lamp 14Y discharges the surface of the drum 11Y. The charge roller 15Y uniformly charges the surface of the drum 11Y. The drum 11Y has a surface layer formed of OPC (Organic PhotoConductor).

In operation, the charge roller 15Y to which a DC voltage is applied uniformly charges the surface of the drum 11Y. The writing unit 2 scans the charged surface of the drum 11Y with a laser beam L modulated in accordance with image data, thereby forming a latent image on the drum 11Y. The developing unit 20Y, which will be described specifically later, develops the latent image with yellow toner to thereby produce a yellow toner image. At an image transfer position Pt assigned to the Y image station 1Y, the toner image is transferred from the drum 11Y to a paper sheet 100. After the image transfer, the brush roller 12Y applies a preselected amount of lubricant to the surface of the drum 1Y. Subsequently, the counter blade 13Y cleans the surface of the drum 11Y. Further, the discharge lamp 14Y discharges the cleaned surface of the drum 11Y with light, thereby preparing the drum 11Y for the next image formation.

The developing unit 20Y stores a developer consisting of magnetic carrier particles and negatively charged, toner particles, i.e., a two-ingredient type developer. A case 21Y accommodates a developing roller or developer carrier 22Y, a pair of screw conveyors 24Y and 24Y, a doctor blade 25Y, a toner content sensor (T sensor) 26Y, and a powder pump 27Y. The developing roller 22Y is partly exposed to the outside through an opening formed in the case 21Y. The screw conveyors 23Y and 24Y convey the developer while agitating it and thereby charging it by friction. Part of the charged developer is deposited on the surface of the developing roller 22Y and conveyed thereby. The doctor blade 25Y regulates the thickness of the developer being conveyed by the developing roller 22Y. At a developing position where the developing roller 22Y faces the drum 11Y, the toner contained in the developer develops the latent image formed on the drum 11Y. The toner content sensor 26Y senses the toner content of the developer stored in the case 21Y. The powder pump 27Y replenishes fresh toner to the case 21Y in accordance with the output of the toner content sensor 26Y.

Figure 4:
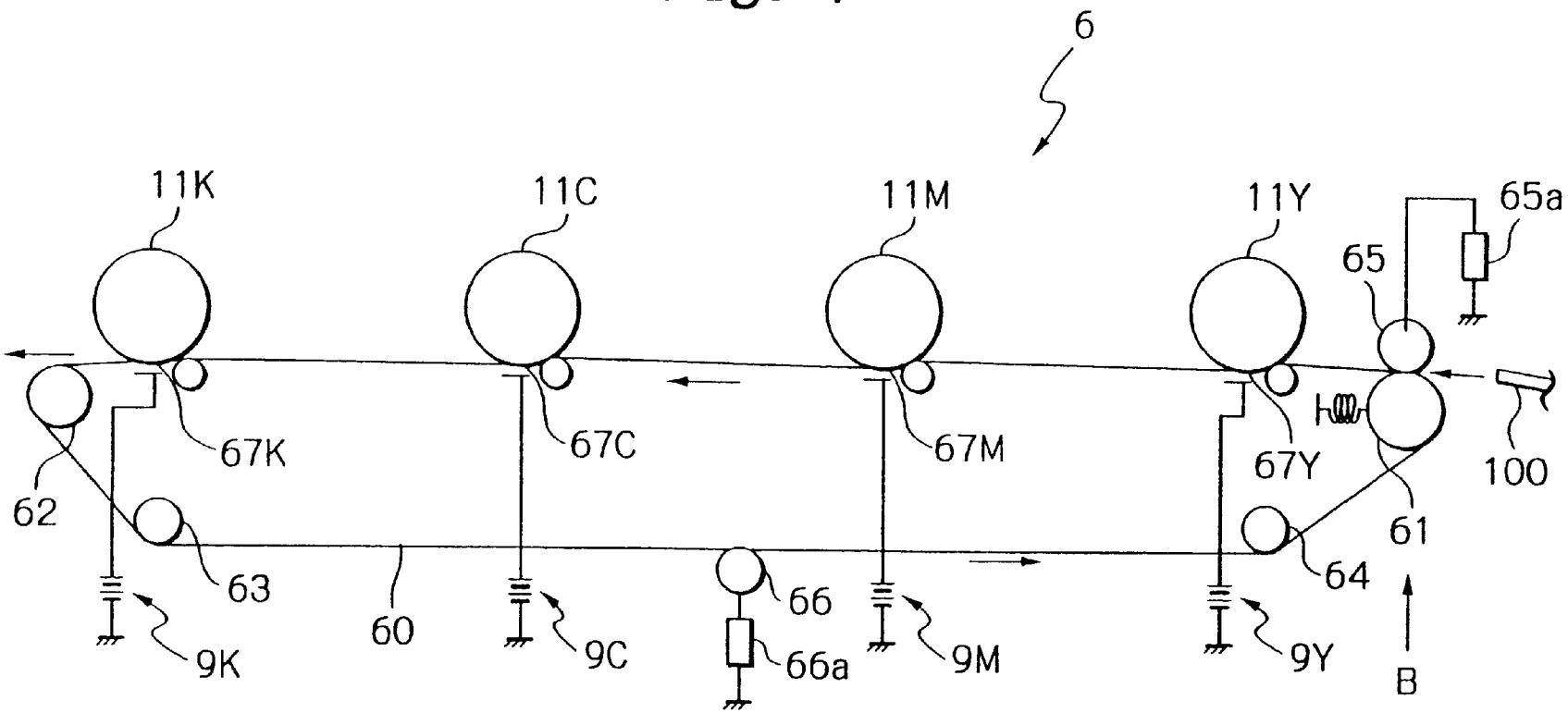
FIG. 4 is a view showing a belt unit also included in the illustrative embodiment together with arrangements around the belt unit.

FIG. 4 shows the general construction of the image transfer unit 6. In the illustrative embodiment, the belt 60 is implemented as a single layer belt having a volume resistivity as high as $10^9\Omega$cm to $10^{11}\Omega$cm and is formed of polyvinylidene fluoride (PVDF) The belt 60 is passed over four support rollers 61 through 64 such that it runs in contact with the drums 11Y through 11K. The support roller 61 positioned at the upstream side in the direction of sheet feed applies tension to the belt 60. A power supply 65*a* applies a preselected voltage to a roller 65 that faces the support roller 61. A paper sheet passed between the two rollers 61 and 65 electrostatically adheres to the belt 60. The support roller or outlet roller 62 positioned at the downstream side in the direction of sheet feed drives the belt 60 by friction. A drive source, not shown, is connected to the support roller 62. A bias roller 66 is held in contact with the outer surface of the belt 60 between the support rollers 63 and 64. A power supply 66a applies a preselected voltage for cleaning to the bias roller 66. In this condition, the bias roller 66 removes toner and other impurities deposited on the belt 60.

Bias applying members 67Y, 67M, 67C and 67K contact the inner surface of the belt 60 at the image transfer positions where the belt 60 forms nips between it and the drums 11Y, 11K, 11C, 11M and 11Y, respectively. Playing the role of electric field forming means for image transfer, the bias applying members 67Y through 67K are implemented by fixed brushes formed of Mylar (trade name). Bias power supplies 9Y, 9M, 9C and 9K apply transfer biases to the bias applying members 67Y, 67M, 67C and 67K, respectively. The bias applying members 67Y through 67K each form an electric field of preselected strength between the belt 60 and associated one of the drums 11Y through 11K.

An anti-deviation guide, not shown, is positioned on one of opposite edges of the belt 60 in the direction of width for preventing the belt 60 in movement from deviating. An annular guide groove, not shown, is formed in each of the support rollers 61 through 64 and receives the anti-deviation guide. The anti-deviation guide received in the guide grooves of the support rollers 61 through 64 prevents the belt 60 from deviating and thereby allows the belt 60 to move stably. This kind of configuration, however, brings about the problems discussed earlier.

To solve the problems, the illustrative embodiment causes higher tension to act on the side of the belt 60 where the anti-vibration guide is absent than at the other side where it is present. Such a tension distribution causes the belt 60 to tend to deviate toward the side where the anti-deviation guide is absent. More specifically, springs, not shown, respectively bias opposite ends of the shaft of the support roller or tension applying roller 61; a greater biasing force acts on the side of the roller 61 where the guide groove is absent than on the side where it is present.

Figure 5A:
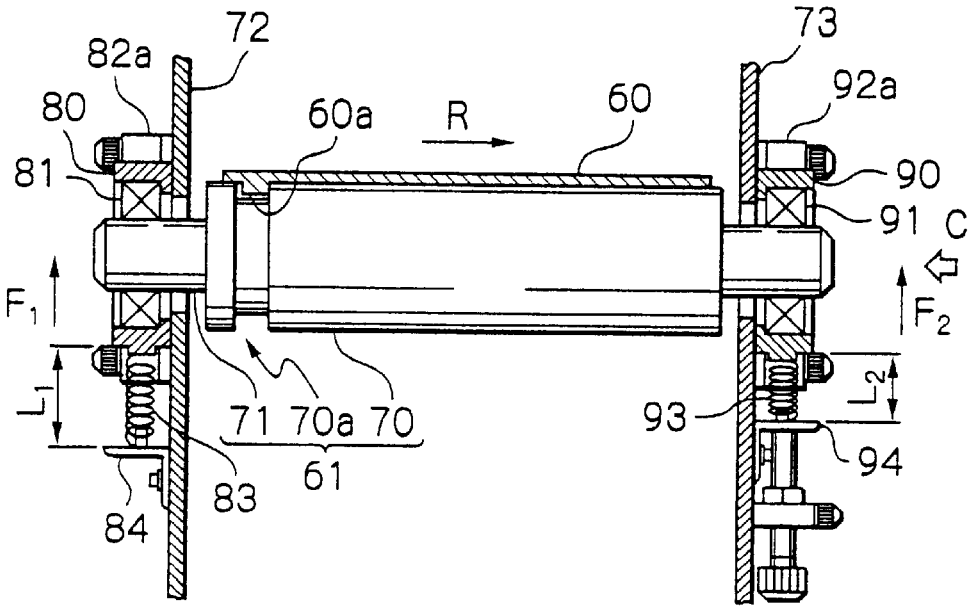
FIG. 5A is a fragmentary enlarged view as seen in a direction B shown in FIG. 4.
Figure 5B:
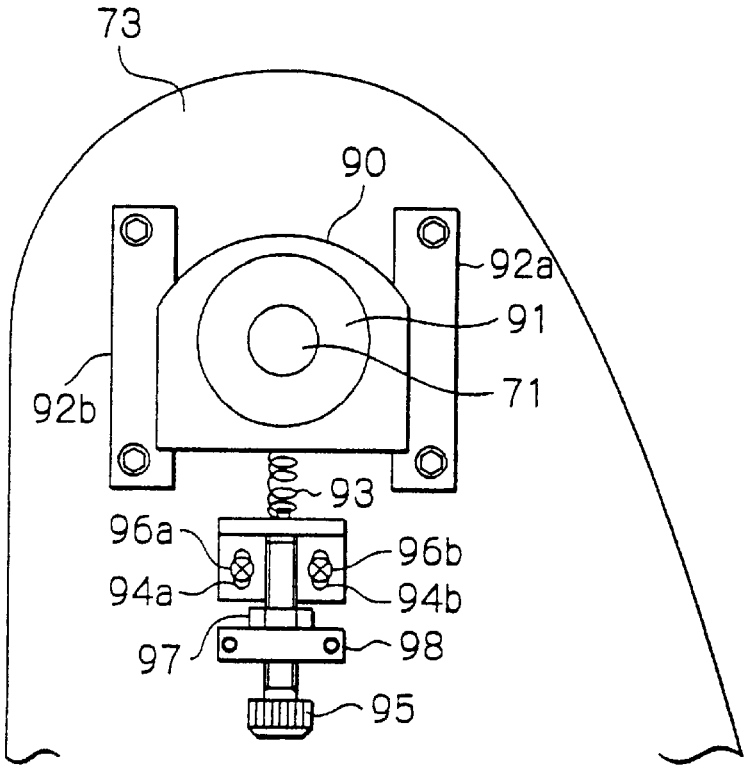
FIG. 5B is a side elevation as seen in a direction C shown in FIG. 5A.

FIG. 5A is an enlarged view of the support roller 61 and members associated therewith, as seen in a direction B shown in FIG. 4. FIG. 5B is a side elevation as seen in a direction C shown in FIG. 5B. As shown, the support roller 61 is made up of a cylindrical roller 70 formed with an annular guide groove 70*a* and a shaft 71 rotatable integrally with the roller 70. Biasing means are positioned at opposite ends of the shaft 71 in order to press the inner surface of the belt 60 and thereby apply tension to the belt 60. First, the biasing means positioned at one end of the shaft 71 close to the guide groove 70*a* of the roller 70 (left biasing means as seen in FIG. 5A) will be described.

A slidable, bearing holder 80 holds a bearing 81 therein. The bearing 81 rotatably supports the end of the shaft 71 close to the guide groove 70*a*. A pair of guide rails 82*a* and 82*b* (only 82*a* is shown) are fastened to a left side wall 72 included in the image transfer unit 6 by screws. The bearing holder 80 is slidably supported by the guide rails 82*a* and 82*b*. A compression spring 83 is loaded between the bearing holder 80 and a generally L-shaped spring seat 84 fastened to the side wall 72. The compression spring 83 constantly biases the bearing holder 80.

The biasing means positioned at the other end of the shaft 71 (right end as seen in FIG. 5A) has the following configuration. The end of the shaft 71 remote from the guide groove 70*a* is also rotatably supported by a bearing 91 held by a slidable, bearing holder 90. A pair of guide rails 92*a* and 92*b* (for 92*b*, see FIG. 5B) are fastened to a right side wall 73 included in the image transfer unit 6 by screws. The bearing holder 90 is slidably supported by the guide rails 92*a* and 92*b*. A compression spring 93 is loaded between the bearing holder 90 and a generally L-shaped spring seat 94 fastened to the side wall 73. The compression spring 93 constantly biases the bearing holder 90. The compression spring 93 should preferably have the same length in an unstressed position and the same spring constant as the compression spring 83. This allows the biasing force to act on the support roller 61 to differ from one end to the other end if the compression springs 83 and 93 each are compressed to a particular length. Further, not only assembly errors are obviated, but also the production cost of parts is reduced.

The spring seat 94 at the right-hand side of the support roller 61 is capable of being shifted in order to adjust the biasing force of the compression spring 93. Specifically, as shown in FIG. 5B, a pair of slots 94*a* and 94*b* are formed in the spring seat 94. The position of the spring seat 94 can therefore be shifted over the length of the slots 94*a* and 94*b*. More specifically, when the spring seat 94 is shifted upward, it raises the end of the compression spring 93 anchored thereto and thereby reduces the compression length of the spring 93, i.e., intensifies the biasing force of the spring 93. When the spring seat 94 is shifted downward, it lowers the above end of the compression spring 94 and thereby reduces the biasing force of the spring 94.

Further, a push bolt 95 facilitates the adjustment of the position of the spring seat 94. To intensify the biasing force of the compression spring 93, the operator loosens a pair of screws 96*a* and 96*b* fastening the spring seat 94 to the side wall 73. The operator then turns the push bolt 95 clockwise in order to raise the spring seat 94 and then tightens the screws 96*a* and 96*b* at a desired position, thereby fixing the spring seat 94. A nut 97 prevents the push bolt 95 from being loosened and rotated relative to a bolt retainer 98. To reduce the biasing force of the compression spring 93, the operator loosens the screws 96*a* and 96*b* fastening the spring seat 94 to the side wall 73. The operator then turns the push bolt 95 counterclockwise in order to raise the spring seat 94 and then tightens the screws 96*a* and 96*b* at a desired position, thereby fixing the spring seat 94.

In the specific configuration shown in FIGS. 5A and 5B, only the biasing means at the right-hand side of the shaft 71 includes the mechanism for adjusting the biasing force. Alternatively, such biasing means may be included in the other biasing means as well or only in the other biasing means.

As shown in FIG. 5A, assume that a biasing force $F_1$ acts on the end of the shaft 71 close to the guide groove 70*a* of the guide roller 61, and that a biasing force $F_2$ acts on the other end of the shaft 71 remote from the guide groove 70*a*. Then, the illustrative embodiment selects the following relation:

$$F_1<F_2<1.5\times F_1 \quad (1)$$

When the biasing forces $F_1$ and $F_2$ satisfy the above relation (1), tension acting on the belt 60 is higher at the side where the anti-deviation guide 60*a* is absent than at the other side where it is present. Generally, a belt deviates to a side where tension is intense in the direction of width. The belt 60 therefore deviates to the side where the anti-deviation guide 60*a* is absent, as indicated by an arrow R in FIG. 5A. However, the anti-deviation guide 60*a* received in the guide groove 70*a* limits the deviation of the belt 60. At this instant, the belt 60 deviates in the direction in which the image transfer surface extends, so that the image transfer surface is free from slackening and creasing. In addition, the anti-deviation guide 60*a* does not rise or gets over the guide groove 70*a*.

Further, as shown in FIG. 5A, assume that the compression springs 83 and 93 have compression lengths $L_1$ and $L_2$, respectively. Then, to satisfy the relation (1), the illustrative embodiment selects the following relation:

$$L1>L2$$

If the biasing force F2 is excessively great relative to the biasing force F1, then it accelerates the deterioration of the anti-deviation guide 60*a*. We conducted a series of experiments and found that if the force $F_2$ is less than 1.5 times of the biasing force $F_1$ (relation (1)), then the anti-deviation guide 60*a* is prevented from being deteriorated at an early stage of operation.

In the illustrative embodiment, the guide groove 70*a* is formed in the support roller 61 and engaged with the anti-deviation guide or guide member 60*a* formed on the belt 60. Alternatively, the end face of the support roller 61 may be so configured as to guide such a guide member.

The present invention is practicable not only with the two-ingredient type developer, but also with a single-ingredient type developer, i.e., toner. Also, the present invention is practicable with any desired number of image stations (four in the illustrative embodiment) It should be noted that the laser printer shown and described is a specific form of an image forming apparatus of the type including a plurality of image stations and sequentially transferring toner images of different colors from image carriers included in the image stations to an intermediate image transfer body or a paper sheet or similar recording medium.

In summary, it will be seen that the present invention provides a belt driving device and an image forming apparatus having various unprecedented advantages, as enumerated below.

(1) Low-cost arrangements suffice for freeing the outer surface of an endless belt from slackening and creasing and for preventing a guide member on the belt from getting over a guide portion formed in each support roller. This insures the stable movement of the belt.

(2) Assembly errors are obviated while the production cost of parts is reduced, compared to an arrangement in which compression springs different in length in an unstressed position or in spring constant are used.

(3) A force causing the belt to deviate to the side where the guide member is absent can be adequately set. An excessively great force would cause the guide member to wear while an excessively small force would cause the image transfer surface to slacken or crease.

(4) The belt stably rotates and insures high image quality over a long time.

Various modifications will become possible for those skilled in the art after receiving the teachings of the present disclosure without departing from the scope thereof.

What is claimed is:

1. A belt driving device comprising:

an endless belt member;

a plurality of roller members over which said belt member is passed;

drive means for causing at least one of said plurality of roller members to rotate;

biasing means for pressing opposite ends of at least one of said plurality of roller members to thereby apply tension to said belt member;

a guide member formed on an inner surface of said belt member at one of opposite sides in a direction of width of said belt member for guiding said belt member; and a guide portion formed in each of said plurality of roller members and engaged with said guide member;

wherein said biasing means is configured such that a biasing force $F_2$ acting on one end of said at least one roller member remote from said guide member of said belt member is greater than a biasing force $F_1$ acting on the other side close to said guide member, the biasing means comprising a pair of compression springs identical in length in an unstressed position and in spring constant for respectively biasing the opposite ends of said roller member, and when said belt member is passed over said plurality of roller members, one of said pair of compression springs biasing the end of said roller member remote from said guide member of said belt has a smaller compression length than the other compression spring.

2. The device as claimed in claim 1, further comprising adjusting means for adjusting a length of at least one of said pair of compression springs.

3. The device as claimed in claim 1, wherein when said plurality of roller members comprise four roller members, the biasing forces $F_1$and $F_2$ satisfy a relation:

$$F_1<F_2<1.5\times F_1.$$

4. An image forming apparatus comprising:

a plurality of image stations each including a respective image carrier on which a toner image is formed; and a belt driving device for driving an image transfer belt that conveys a recording medium to which the toner image is transferred;

wherein said image transfer belt conveys the recording medium via image transfer positions, each of which is assigned to a particular image carrier included in each image station, so that toner images are sequentially transferred from image carriers to the recording medium one above the other;

said belt driving device comprising:

an endless belt member;

a plurality of roller members over which said belt member is passed;

drive means for causing at least one of said plurality of roller members to rotate;

biasing means for pressing opposite ends of at least one of said plurality of roller members to thereby apply tension to said belt member;

a guide member formed on an inner surface of said belt member at one of opposite sides in a direction of width of said belt member for guiding said belt member; and a guide portion formed in each of said plurality of roller members and engaged with said guide member;

wherein said biasing means is configured such that a biasing force $F_2$ acting on one end of said at least one roller member remote from said guide member of said belt member is greater than a biasing force $F_1$ acting on the other side close to said guide member, said biasing means comprising a pair of compression springs identical in length in an unstressed position and in spring constant for respectively biasing the opposite ends of said roller member, and when said belt member is passed over said plurality of roller members, one of said pair of compression springs biasing the end of said roller member remote from said guide member of said belt has a smaller compression length than the other compression spring.

5. The device as claimed in claim 4, further comprising adjusting means for adjusting a length of at least one of said pair of compression springs.

6. The device as claimed in claim 5, wherein when said plurality of roller members comprise four roller members, the biasing forces $F_1$ and $F_2$ satisfy a relation:

$$F_1<F_2<1.5\times F_1.$$

7. A belt driving device comprising:

an endless belt member;

a plurality of roller members over which said belt member is passed;

a driving device for causing at least one of said plurality of roller members to rotate;

a biasing device for pressing opposite ends of at least one of said plurality of roller members to thereby apply tension to said belt member;

a guide member formed on an inner surface of said belt member at one of opposite sides in a direction of width of said belt member for guiding said belt member; and a guide portion formed in each of said plurality of roller members and engaged with said guide member;

wherein said biasing device is configured such that a biasing force $F_2$ acting on one end of said at least one roller member remote from said guide member of said belt member is greater than a biasing force $F_1$ acting on the other side close to said guide member, said biasing device comprising a pair of compression springs identical in length in an unstressed position and in spring constant for respectively biasing the opposite ends of said roller member, and when said belt member is passed over said plurality of roller members, one of said pair of compression springs biasing the end of said roller member remote from said guide member of said belt has a smaller compression length than the other compression spring.

8. The device as claimed in claim 7, further comprising an adjusting device for adjusting a length of at least one of said pair of compression springs.

9. The device as claimed in claim 7, wherein when said plurality of roller members comprise four roller members, the biasing forces $F_1$ and $F_2$ satisfy a relation:

$$F_1<F_2<1.5\times F_1.$$

10. An image forming apparatus comprising:

a plurality of image stations each including a respective image carrier on which a toner image is formed; and a belt driving device for driving an image transfer belt that conveys a recording medium to which the toner image is transferred;

wherein said image transfer belt conveys the recording medium via image transfer positions, each of which is assigned to a particular image carrier included in each image station, so that toner images are sequentially transferred from image carriers to the recording medium one above the other;

said belt driving device comprising:

an endless belt member;

a plurality of roller members over which said belt member is passed;

a driving device for causing at least one of said plurality of roller members to rotate;

a biasing device for pressing opposite ends of at least one of said plurality of roller members to thereby apply tension to said belt member;

a guide member formed on an inner surface of said belt member at one of opposite sides in a direction of width of said belt member for guiding said belt member; and a guide portion formed in each of said plurality of roller members and engaged with said guide member;

wherein said biasing device is configured such that a biasing force $F_2$ acting on one end of said at least one roller member remote from said guide member of said belt member is greater than a biasing force $F_1$ acting on the other side close to said guide member, said biasing device comprising a pair of compression springs identical in length in an unstressed position and in spring constant for respectively biasing the opposite ends of said roller member, and when said belt member is passed over said plurality of roller members, one of said pair of compression springs biasing the end of said roller member remote from said guide member of said belt has a smaller compression length than the other compression spring.

11. The device as claimed in claim 10, further comprising an adjusting device for adjusting a length of at least one of said pair of compression springs.

12. The device as claimed in claim 10, wherein when said plurality of roller members comprise four roller members, the biasing forces $F_1$ and $F_2$ satisfy a relation:

$$F_1<F_2<1.5\times F_1.$$

13. A belt driving device comprising:

an endless belt member;

a plurality of roller members over which said belt member is passed;

a spring member disposed adjacent opposite ends of a longitudinal shaft of at least one of said plurality of roller members;

each said spring member capable of biasing opposite ends of at least one of said plurality of roller members to thereby apply tension to said belt member;

a guide member formed on an inner surface of said belt member at one of opposite sides of said belt member, in a direction of width, for guiding said belt member; and a guide portion formed in each of said plurality of roller members and engaged with said guide member.

14. The belt driving apparatus as in claim 13, wherein each said spring member is adjustable such that a biasing force acting on one end of said at least one roller member remote from said guide member of said belt member is greater than a biasing force acting on the other side close to said guide member.

15. The belt driving device as in claim 13, wherein said each spring member is identical in length in an unstressed position and in spring constant for respectively biasing the opposite ends of said roller member.

16. The belt driving device as in claim 15, wherein when said belt member is passed over said plurality of roller members, the spring member biasing the end of said roller member remote from said guide member of said belt has a smaller compression length compared to the spring member disposed at an end of said roller member close to the guide member.

17. An image forming apparatus comprising:

a plurality of image stations each including a respective image carrier on which a toner image is formed; and a belt driving device for driving an image transfer belt that conveys a recording medium to which the toner image is transferred;

wherein said image transfer belt conveys the recording medium via image transfer positions, each of which is assigned to a particular image carrier included in each image station, so that toner images are sequentially transferred from image carriers to the recording medium one above the other;

said belt driving device comprising:

an endless belt member;

a plurality of roller members over which said belt member is passed;

a spring member disposed adjacent opposite ends of a longitudinal shaft of at least one of said plurality of roller members;

each said spring member capable of biasing opposite ends of at least one of said plurality of roller members to thereby apply tension to said belt member;

a guide member formed on an inner surface of said belt member at one of opposite sides of said belt member, in a direction of width, for guiding said belt member; and a guide portion formed in each of said plurality of roller members and engaged with said guide member.

* * * * *